US011219304B2

(12) United States Patent
Schwartz

(10) Patent No.: US 11,219,304 B2
(45) Date of Patent: Jan. 11, 2022

(54) PAINT BRUSH DEVICE WITH CONTROLLED PAINT FLOW SYSTEM

(71) Applicant: Philip Louis Schwartz, Las Vegas, NV (US)

(72) Inventor: Philip Louis Schwartz, Las Vegas, NV (US)

( * ) Notice: Subject to any disclaimer, the term of this patent is extended or adjusted under 35 U.S.C. 154(b) by 0 days.

(21) Appl. No.: 17/175,923

(22) Filed: Feb. 15, 2021

(65) Prior Publication Data

US 2021/0251379 A1 Aug. 19, 2021

Related U.S. Application Data

(60) Provisional application No. 62/975,896, filed on Feb. 13, 2020.

(51) Int. Cl.
*A46B 11/00* (2006.01)

(52) U.S. Cl.
CPC ..... *A46B 11/0072* (2013.01); *A46B 11/0006* (2013.01); *A46B 11/0041* (2013.01); *A46B 11/0062* (2013.01); *A46B 2200/202* (2013.01)

(58) Field of Classification Search
CPC ..... A46B 11/00; A46B 11/006; A46B 11/001; A46B 11/002; A46B 11/0041; A46B 11/0062; A46B 11/0072; A46B 2200/202; A46B 2200/20
USPC ..... 401/270, 277, 279, 282, 284, 286, 288, 401/290, 183–186
See application file for complete search history.

(56) References Cited

U.S. PATENT DOCUMENTS 3,485,563 A * 12/1969 Chennell ..... A45D 34/042 401/183
7,854,562 B2 * 12/2010 Peterson ..... A46B 11/0079 401/186
2004/0240929 A1 * 12/2004 Watson ..... A46B 11/0013 401/286

* cited by examiner

*Primary Examiner* — David J Walczak

(57) ABSTRACT

A paint brush device with a controlled paint flow system is an apparatus that facilitates efficient painting process, by providing the user with a paint brush with a reservoir handle. The inside of the reservoir handle contains the user's choice of paint. In order to transfer the paint to a plurality of bristles, the reservoir handle is internally connected to a soft, liquid repellent internal tube, that traverses internally from the reservoir handle towards the plurality of bristles on a removable brush head. The reservoir handle is compressible, therefore when manually compressed, paint travels from the reservoir handle to the plurality of bristles allowing the user to begin the painting process with little to no preparation. Further, the user can allow, control, and stop the paint flow via a control screw. Therefore, the paint brush device decreases preparation time as well as clean-up time efficiently.

19 Claims, 26 Drawing Sheets

PAINT BRUSH DEVICE WITH CONTROLLED PAINT FLOW SYSTEM

The current application claims a priority to the U.S. Provisional Patent application Ser. No. 62/975,896 filed on Feb. 13, 2020. The current application is filed on Feb. 15, 2020 while Feb. 13, 2020 was on a weekend.

FIELD OF THE INVENTION

The present invention relates generally to a paint brush with a compressible reservoir handle for paint. The compressible reservoir handle contains liquid paint. The liquid paint internally travels from the compressible reservoir handle to a brush head via a soft, liquid repellent internal tube. The present invention aims to improve efficiency, functionality and convenience by saving time on paint application and clean-up time.

BACKGROUND OF THE INVENTION

In order to be successful at completing a task or a project, efficiency is critical, as it usually translates to completing a task in a shorter amount of time while still maintaining quality. An improvement in efficiency can be achieved by implementing subtle changes throughout the completion of a task, and/or implementing clever ideas which could result in an innovative product or process. Painting can be a convoluted and disorderly process. Whether the user is painting on a canvas or on a wall, there is always preparation and clean-up time involved. The right precautions are to be taken before beginning to paint. Typically, the user must protect all surfaces that are not meant to be painted. Furthermore, the user must wear adequate clothing that can be exposed to the painting process. Therefore, in order to increase efficiency, an innovative solution to the preparation time and clean-up time must be implemented.

It is an objective of the present invention to provide the user with an innovative solution to the aforementioned problems. In other words, it is an aim of the present invention, to provide an innovative solution to the paint industry. The present invention facilitates the painting process by providing the user with a paint brush with a reservoir handle. The inside of the reservoir handle contains the user's choice of paint. The reservoir handle is internally connected to a soft, liquid repellent internal tube. The soft, liquid repellent internal tube traverses internally from the reservoir handle towards a plurality of bristles on a removable brush head. The reservoir handle is compressible, therefore when manually compressed, paint travels from the reservoir handle to the plurality of bristles allowing the user to begin the painting process with little to no preparation. The user can control the mass flow via a control screw. The control screw allows the user to allow or stop paint mass flow. Therefore, not only has the preparation time decreased, but the clean-up time has also decreased.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 26, the present invention is a paint brush device, with a controlled paint flow system. It is the objective of the present invention to provide an innovative solution to improving efficiency in the painting industry. To that end, the present invention facilitates the painting process by providing the user with a paint brush, that has a reservoir handle. The inside of the reservoir handle contains the user's choice of paint. Further, the reservoir handle is internally connected to a soft, liquid repellent internal tube. The soft, liquid repellent internal tube traverses internally from the reservoir handle towards a plurality of bristles on a removable brush head. Furthermore, the reservoir handle is compressible, therefore when manually compressed, paint travels from the reservoir handle to the plurality of bristles allowing the user to begin the painting process with little to no preparation. Additionally, the user can allow, control, and stop the mass flow of paint via a control screw. Thus, the present invention not only decreases the preparation time, but also helps decrease the clean-up time.

The following description is in reference to FIG. 1 through FIG. 26. According to a preferred embodiment of the present invention, the paint brush device with controlled paint flow system comprises a reservoir handle 1, a head receptacle 2, a brush head 3, and a fluid delivery system 4. Preferably, the reservoir handle 1 is manufactured out of a compressible material such that the user may manually compress the reservoir handle 1, while still maintaining structural integrity of the reservoir handle 1. Further, as seen in FIG. 1 through FIG. 6, the reservoir handle 1 is shaped as a tapered cylinder. However, the reservoir handle 1 may comprise any other material, shape, dimensions, components, arrangement of components etc. that are known to one of ordinary skill in the art, as long as the objectives of the present invention are not altered.

Figure 1:
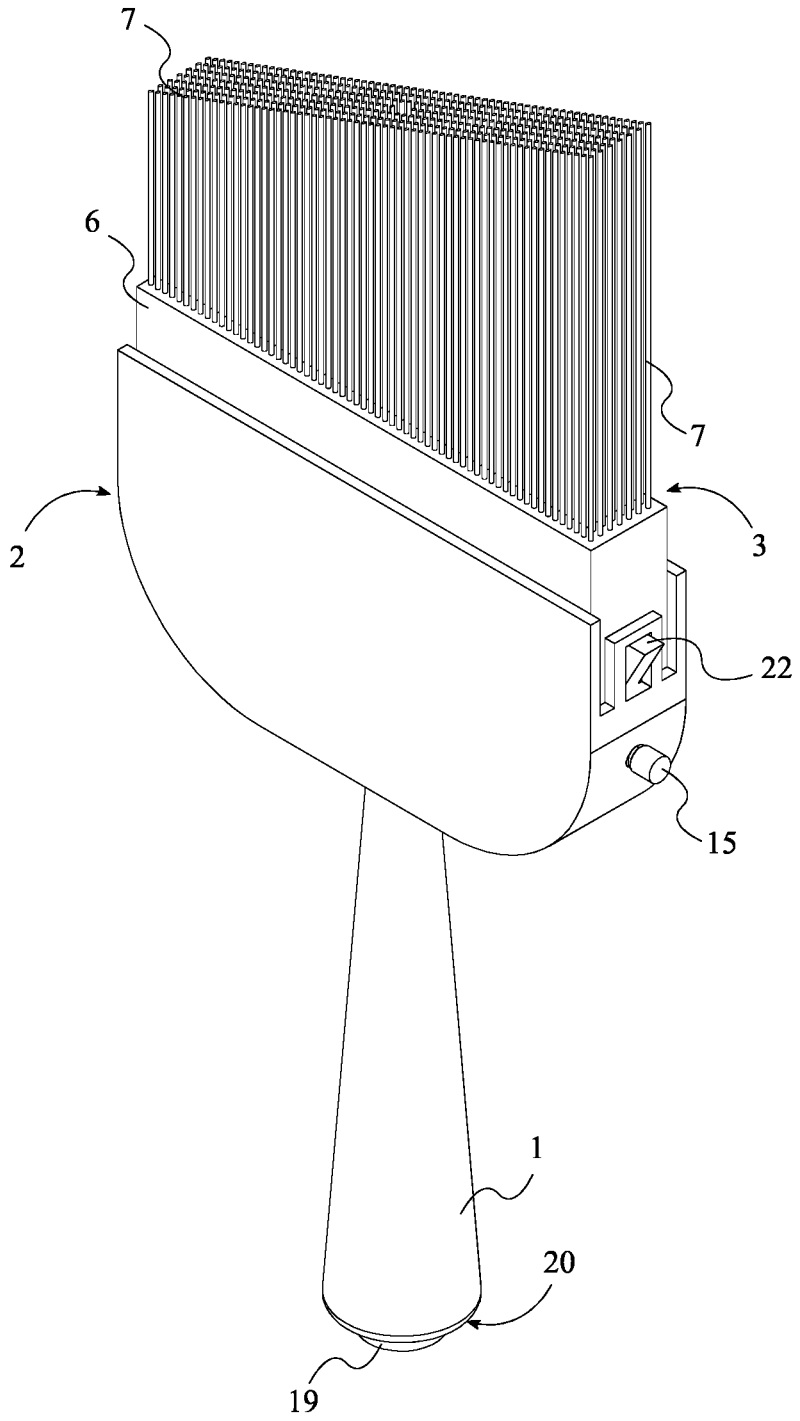
FIG. 1 is a top-front-right perspective view of the present invention.
Figure 2:
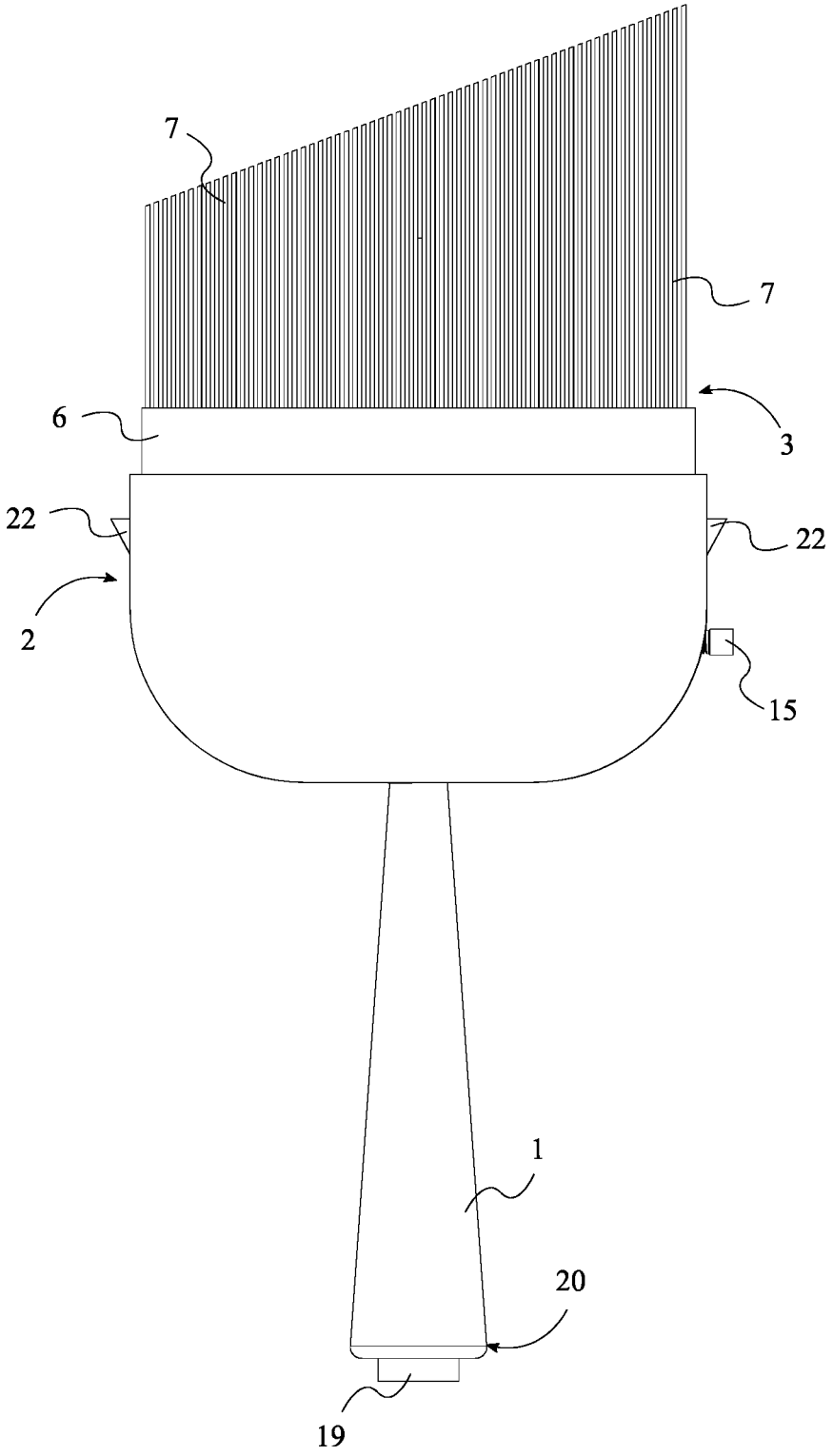
FIG. 2 is a front view of the present invention.
Figure 3:
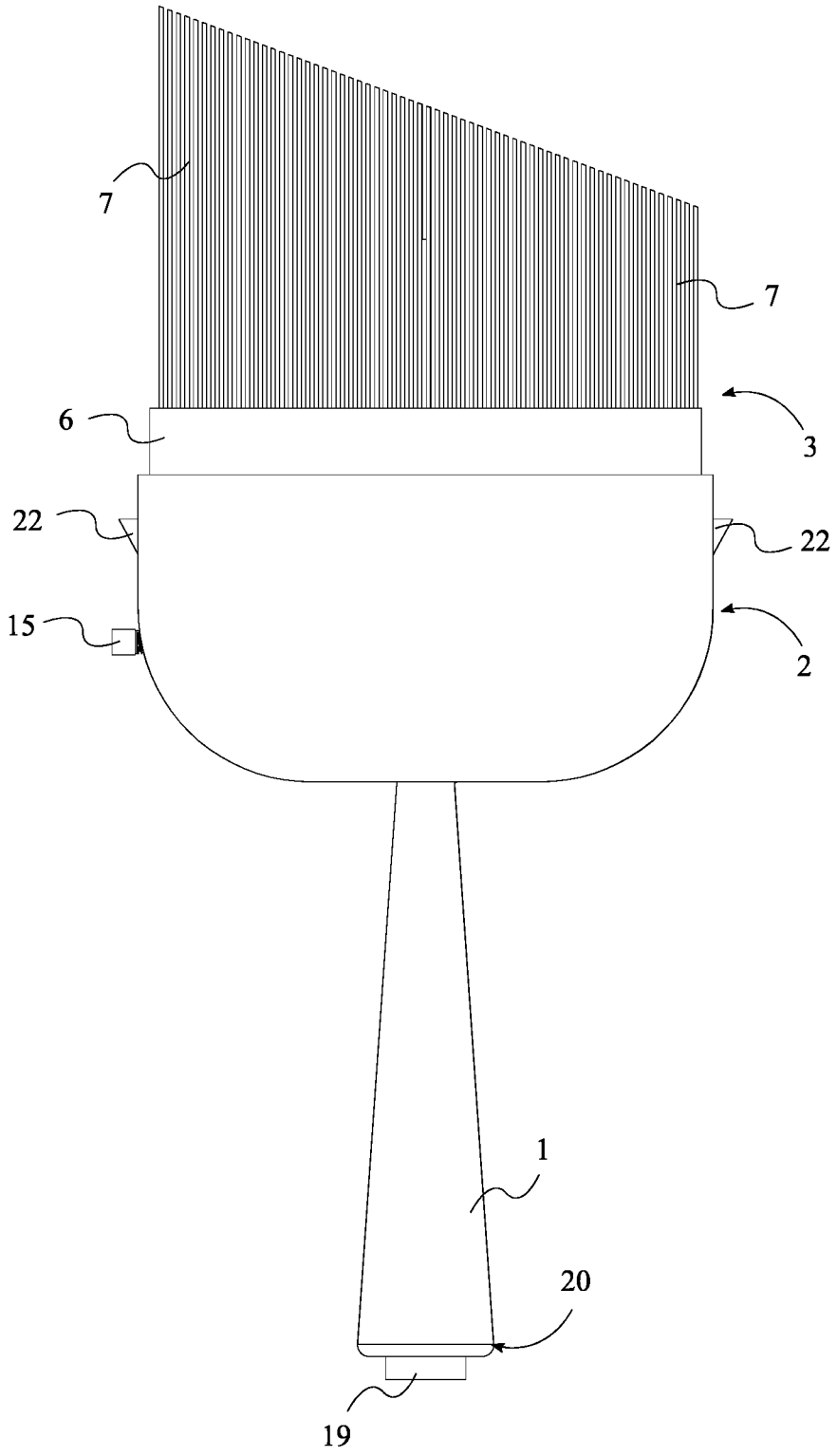
FIG. 3 is a rear view of the present invention.
Figure 4:
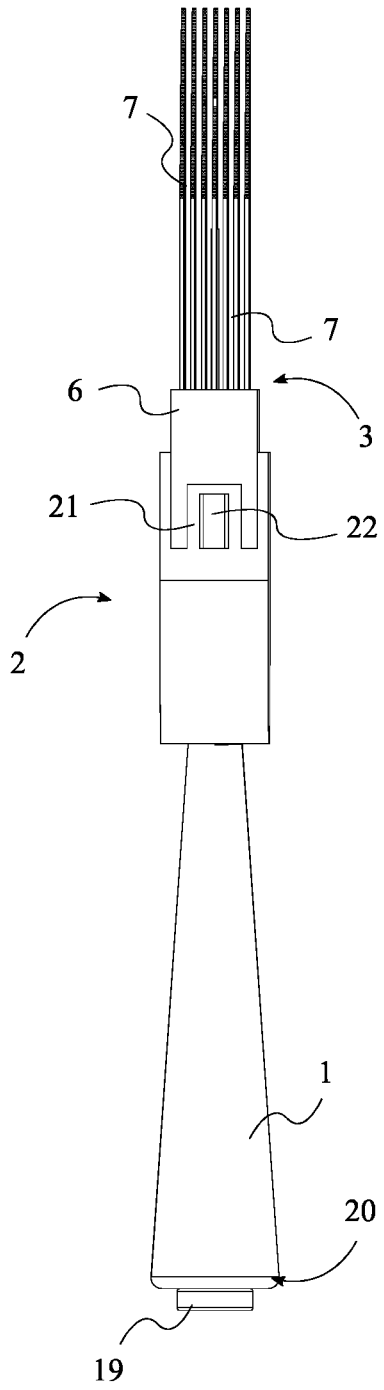
FIG. 4 is a left view of the present invention.
Figure 5:
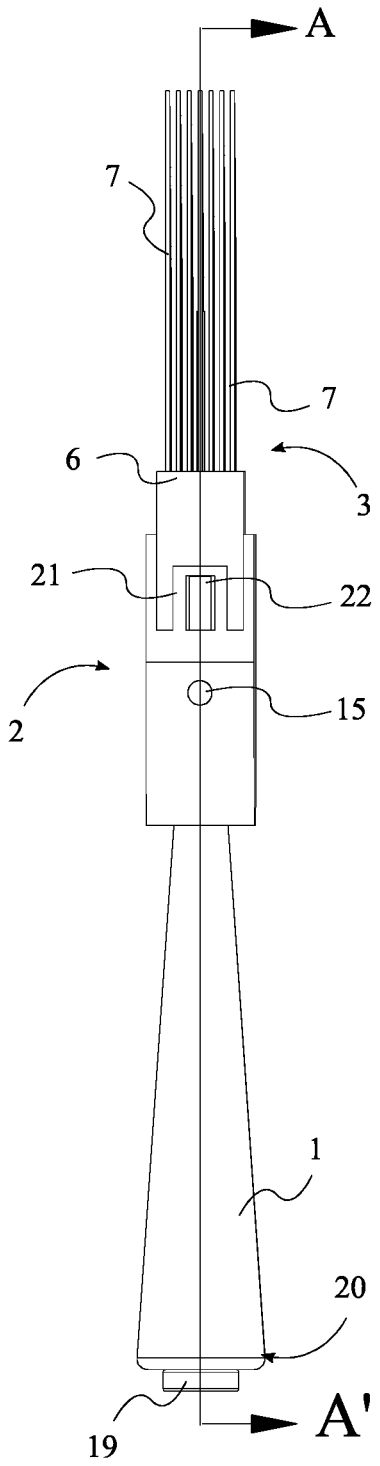
FIG. 5 is a right view of the present invention.
Figure 6:
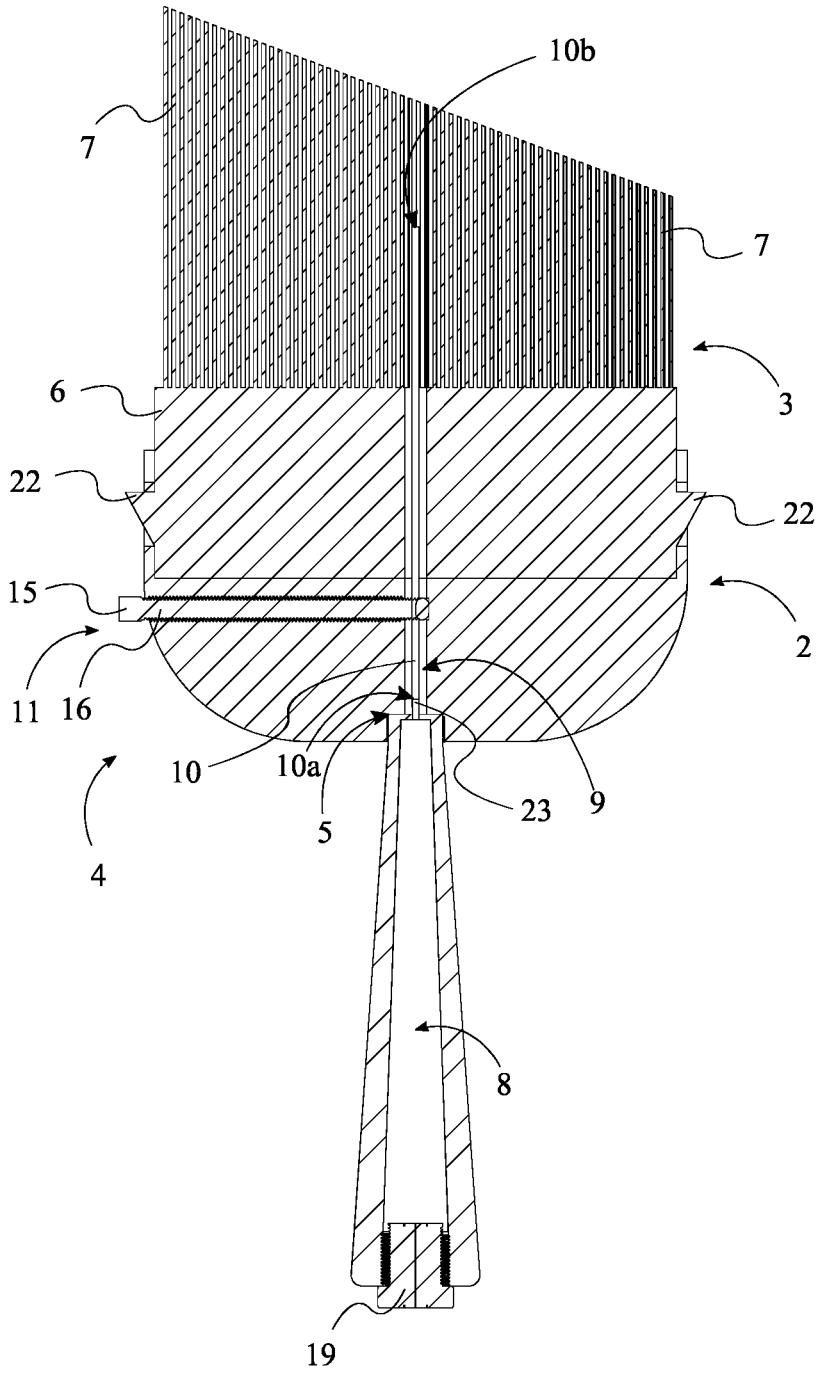
FIG. 6 is a cross-section view of FIG. 5 along the line A-A' of the present invention.
Figure 7:
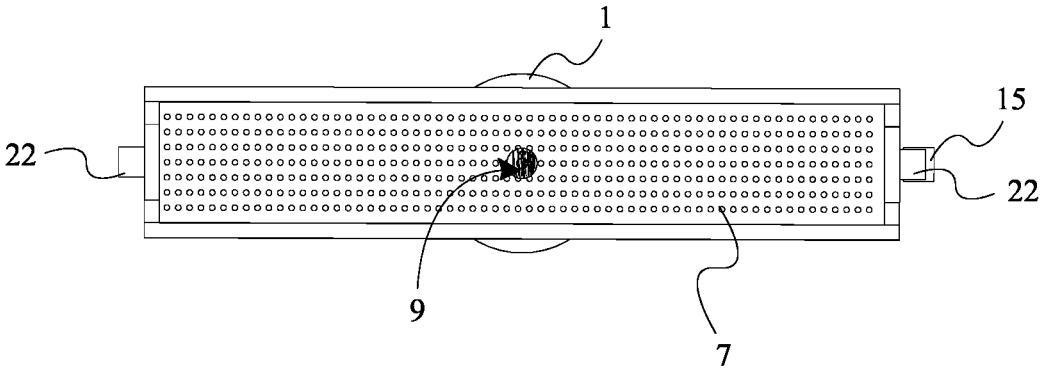
FIG. 7 is a top view of the present invention.
Figure 8:
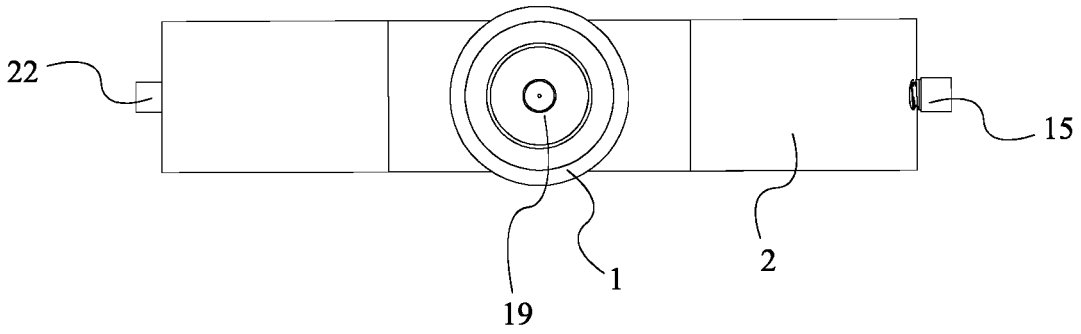
FIG. 8 is a bottom view of the present invention.
Figure 9:
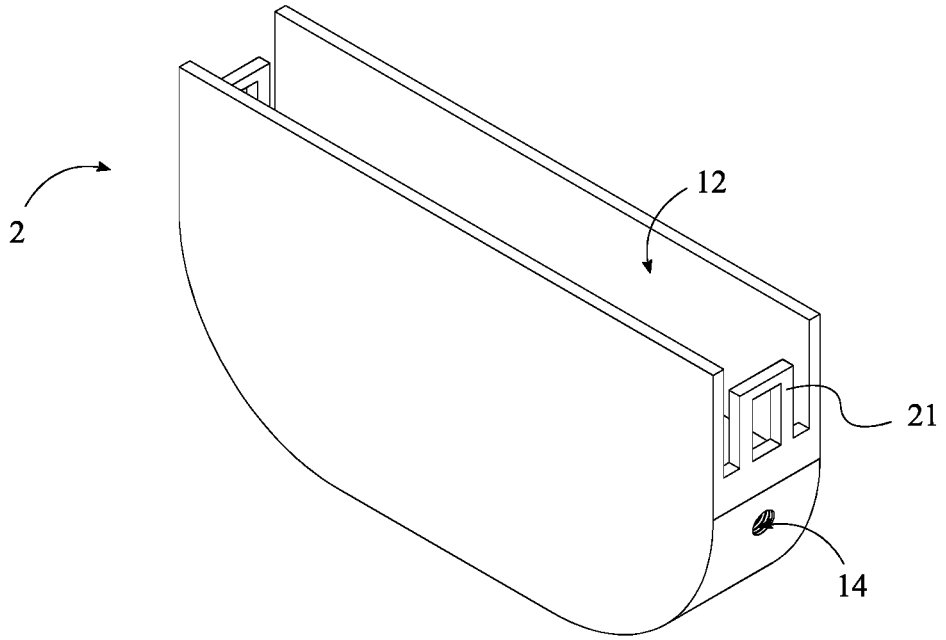
FIG. 9 is a perspective view of a head receptacle of the present invention.
Figure 10:
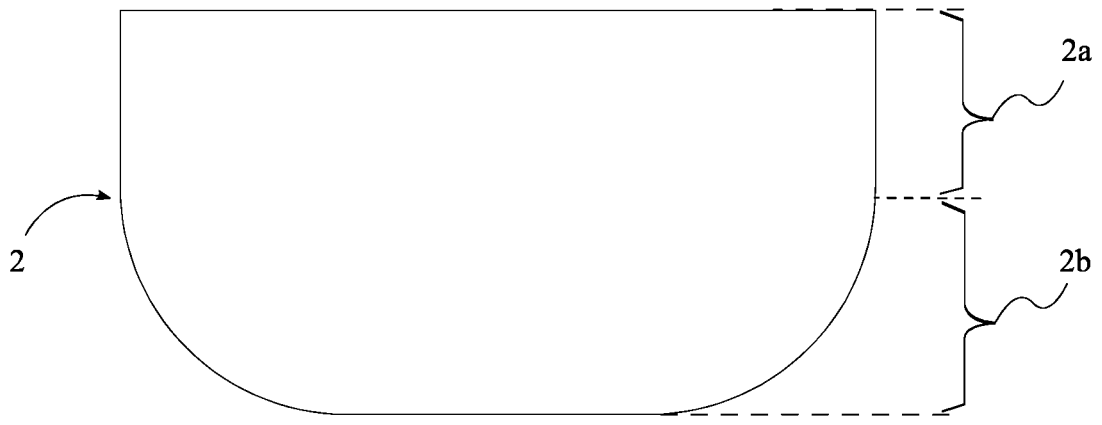
FIG. 10 is a front view of the head receptacle of the present invention.
Figure 11:
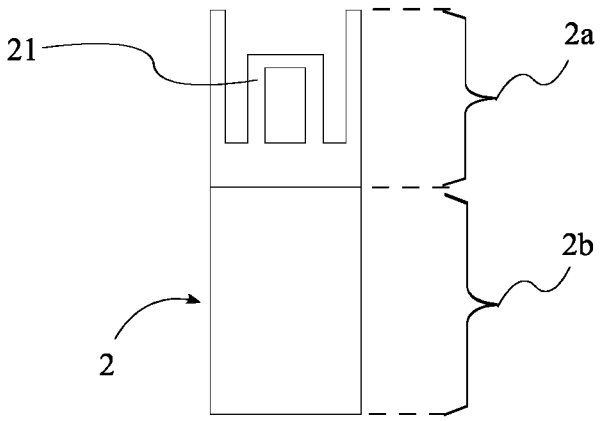
FIG. 11 is a left view of the head receptacle of the present invention.
Figure 12:
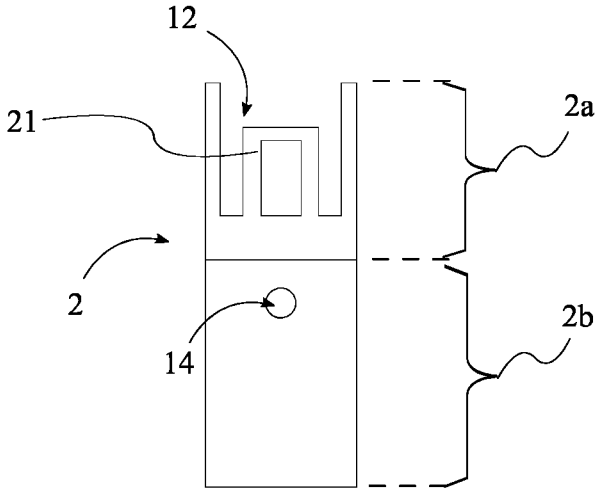
FIG. 12 is a right view of the head receptacle of the present invention.
Figure 13:
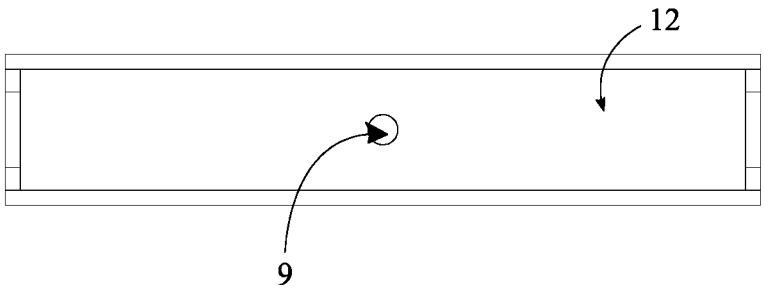
FIG. 13 is a top view of the head receptacle of the present invention.
Figure 14:
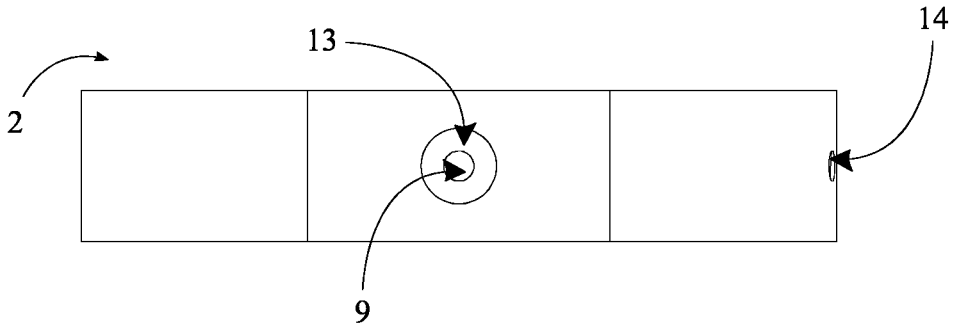
FIG. 14 is a bottom view of the head receptacle of the present invention.

In order to enable the smooth functioning of the present invention, the head receptacle 2 is detachably mounted in between a first end 5 of the reservoir handle 1 and the brush head 3. As seen in FIG. 6, the first end 5 of the reservoir handle constitutes an upper end of the reservoir handle 1, to which the head receptacle 2 is attached. According to the preferred embodiment, the brush head 3 comprises a head body 6 and a plurality of bristles 7, wherein the plurality of bristles 7 is mounted adjacent to the head body 6, opposite to the reservoir handle 1. It is preferred that the brush head 3 fits within the dimensions of the head receptacle 2. As seen in FIG. 1 through FIG. 5, the head receptacle 2 comprises a flattened hemispherical shape and the brush head 3 comprises an oblique layer of plurality of bristles 7 disposed on a rectangular head body 6. However, the brush head 3 and head receptacle 2 may comprise any other shape, size, components and arrangement of components that are known to one of ordinary skill in the art, as long as the objectives of the present invention are fulfilled.

It is an aim of the present invention to deliver a controlled flow of paint to the brush head 3, as needed by the user. In order to accomplish this, the fluid delivery system 4 comprises at least one storage cavity 8, at least one fluid canal 9, at least one fluid delivery tube 10, and a flow control device 11. According to the preferred embodiment, the reservoir handle 1 also acts as the storage container for the paint. To that end, the storage cavity 8 is positioned within the reservoir handle 1, and the user may fill the storage cavity 8 with the user's choice of paint. In the preferred embodiment, the fluid canal 9 traverses through the head receptacle 2 and the brush head 3, and the fluid delivery tube 10 is threaded through the fluid canal 9. Preferably, the fluid delivery tube 10 is a soft, compressible, and liquid repellent tube that is long enough to traverse from the reservoir handle 1 to the brush head 3. Further, the fluid delivery tube 10 and the fluid canal 9 are designed to have circular profiles, and the diameter of the fluid canal 9 is preferably larger than the diameter of the fluid delivery tube 10. This is so that the fluid delivery tube 10 fits perfectly within the fluid canal 9 and enables the smooth operation of the present invention. To that end, as seen in FIG. 6, the fluid canal 9 traverses normally and centrally through the head receptacle 2 and the head body 6.

In order to transfer paint efficiently from the storage cavity 8 to the plurality of bristles 7, a first end of the fluid delivery tube 10*a* is in fluid communication with the storage cavity 8, and a second end of the fluid delivery tube 10*b* extends out of the brush head 3. In other words, the fluid delivery tube 10 delivers paint from the storage cavity 8 to the plurality of bristles 7 via the first end of the fluid delivery tube 10*a* and the second end of the fluid delivery tube 10*b*. Continuing with the preferred embodiment of the present invention, the flow control device 11 is operatively coupled to the fluid delivery tube 10, wherein manipulating the flow control device 11 governs the flow of fluid out of the storage cavity 8 and through the fluid delivery tube 10. Thus, the present invention enables the user to start, control, and stop of the flow of paint through the fluid delivery tube 10, with the help of the flow control device 11.

Figure 15:
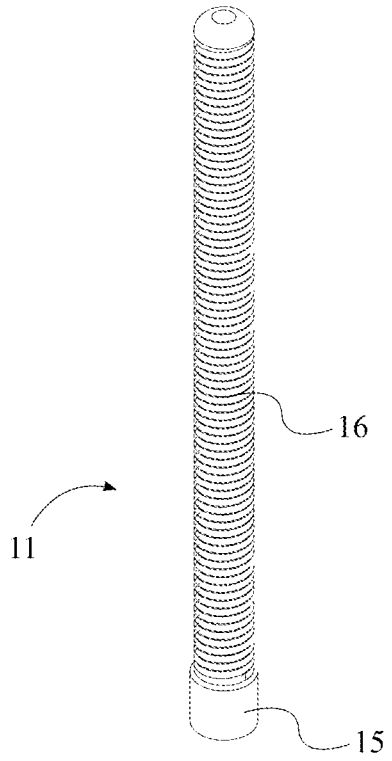
FIG. 15 is a perspective view of a flow control device of the present invention.
Figure 16:
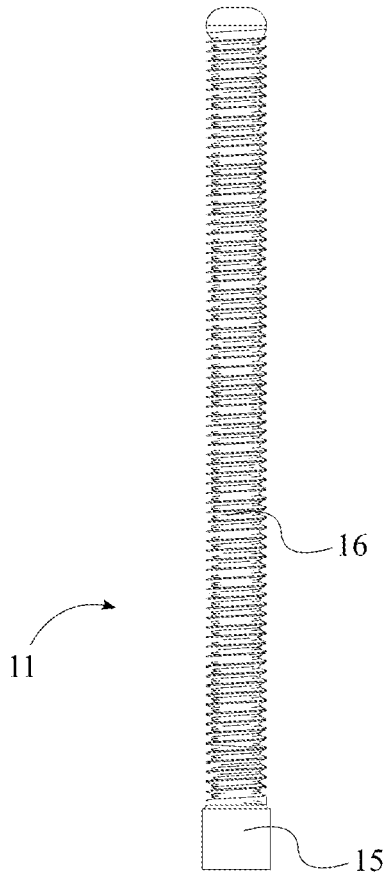
FIG. 16 is a front view of the flow control device of the present invention.
Figure 17:
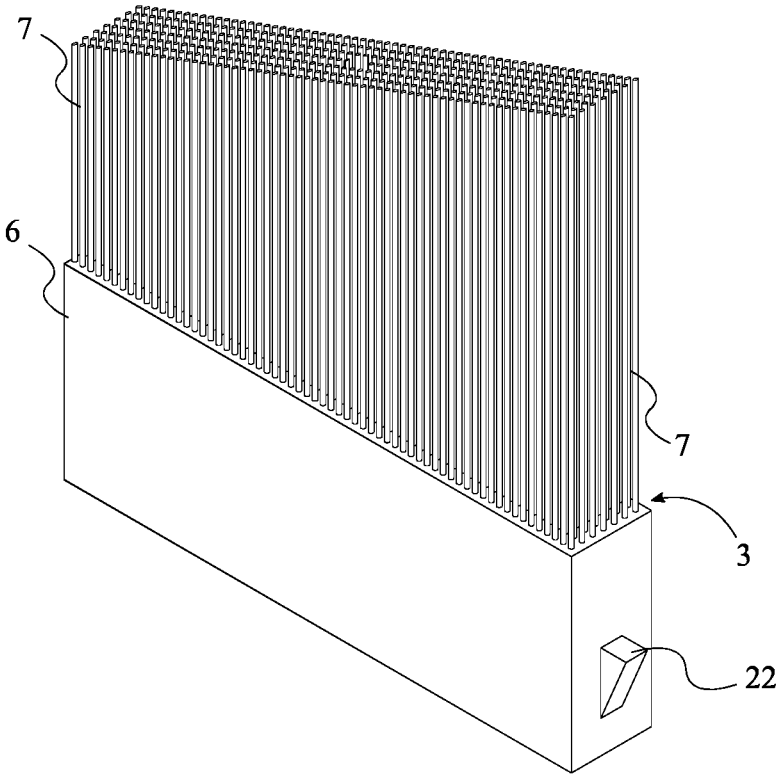
FIG. 17 is a perspective view of a removable brush head of the present invention.
Figure 18:
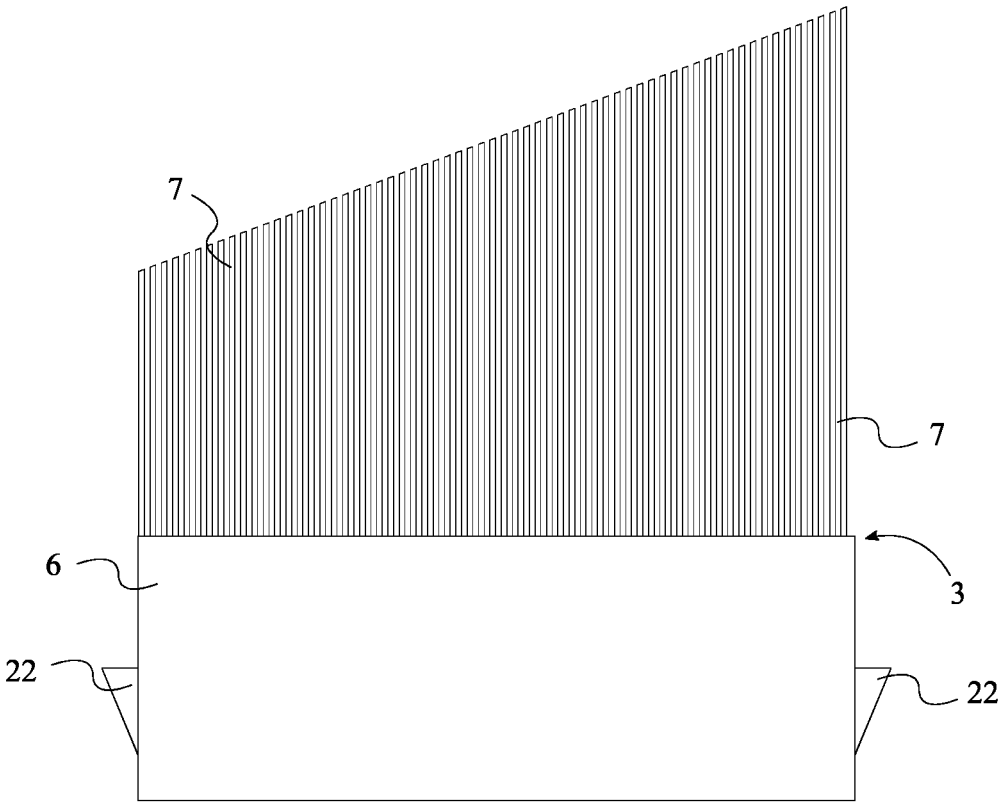
FIG. 18 is a front view of the removable brush head of the present invention.
Figure 19:
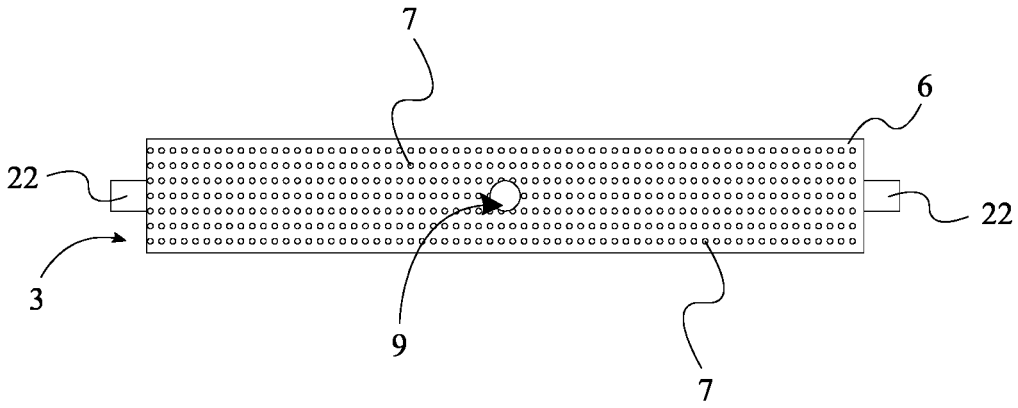
FIG. 19 is a top view of the removable brush head of the present invention.
Figure 20:
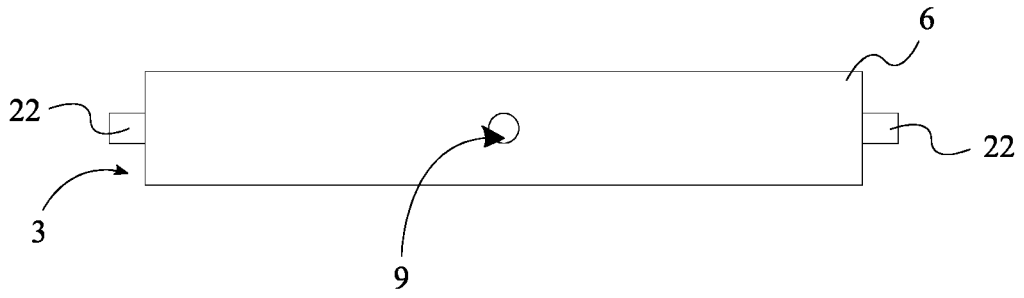
FIG. 20 is a bottom view of the removable brush head of the present invention.

According to the preferred embodiment, the head receptacle 2 forms the link between the reservoir handle 1 and the brush head 3 and serves as the receptacle for multiple components that are crucial for the smooth functioning of the present invention. To that end, the head receptacle 2 comprises a recess 12, a handle port 13, and a control canal 14. Preferably, the recess 12 traverses into a first section 2*a* of the head receptacle 2, wherein the recess 12 serves as a cavity for the removable brush head 3. More specifically, the brush body 6 is mounted within the recess 12, and this arrangement allows the user to interchange between different removable brush heads 3 with different bristle style. Further, the handle port 13 traverses into a second section 2*b* of the head receptacle 2, opposite to the recess 12, so that the reservoir handle 1 may be mounted to a lower end of the head receptacle 2. In other words, the first section 2*a* constitutes an upper section of the head receptacle 2 where the brush gets attached and the second section 2*b* constitutes the lower section of the head receptacle 2 where the reservoir handle 1 gets attached. Preferably, the first section 2*a* is hollow due to the recess 12 and the second section 2*b* is a solid section with multiple apertures. Accordingly, a portion of the fluid canal 9 traverses normally and centrally through the second section 2*b*. The handle port 13 and the fluid canal 9 serve as a pathway for the fluid delivery tube 10 to traverse from the reservoir handle 1 towards the plurality of bristles 7. Furthermore, the head receptacle 2 also holds the flow control device 11 which is crucial in controlling the flow of paint within the device. To accomplish this, the control canal 14 laterally traverses through the second section 2*b* and the flow control device 11 is threaded through the control canal 14. As seen in FIG. 6, the control canal 14 is a pathway located perpendicular to the fluid canal 9, and the control canal 14 serves as a pathway for the flow control device 11. In the preferred embodiment, the control canal 14 extends into the fluid canal 9, so that as the flow control device 11 may extend into the fluid canal 9. This arrangement enables the flow control device 11 to pinch the compressible fluid delivery tube 10, so as to control or stop the mass flow of paint in the fluid delivery tube 10. Preferably, as seen in FIG. 15, and FIG. 16, the flow control device 11 comprises a screw head 15 and a screw body 16, wherein the screw head 15 is terminally connected to the screw body 16. The control canal 14 and the screw body 16 are designed to include matching threads and matching geometric profiles, such that the screw body 16 is rotatably coupled with the control canal 14. Therefore, when the screw body 16 rotates in a clockwise fashion, the flow control device 11 displaces further into the fluid canal 9, leading to a pinching of the fluid delivery tube 10, thus stopping the mass flow of paint. The flow control device 11 must be sufficient in length such that it can still be accessed by the user. Therefore, the screw body 16 must slightly protrude outwards the head receptacle 2, but colinear with the control canal 14. In other words, the screw head 15 protrudes outside the head receptacle 2 adjacent the control canal 14, so that a user may easily hold and operate the screw head 15. However, the head receptacle 2, and the flow control device 11 may comprise any other shape, dimension, technology, components and arrangement of components that are known to one of ordinary skill in the art, as long as the intents of the present invention are fulfilled.

Figure 24:
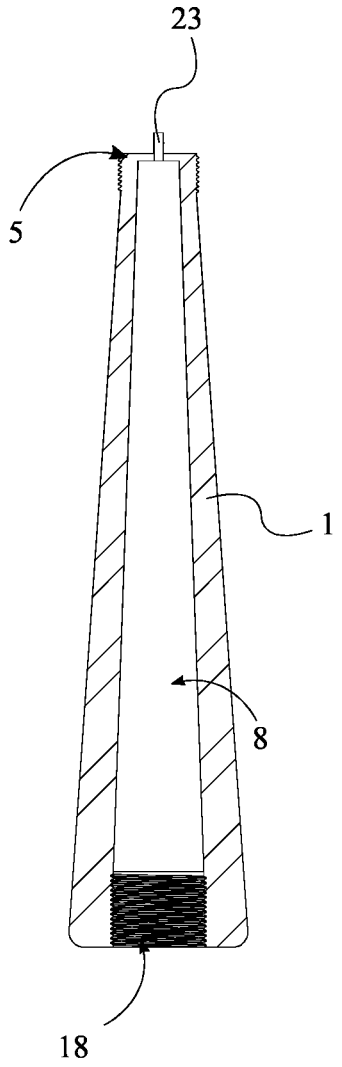
FIG. 24 is a cross-section view of FIG. 23 along the line B-B' of the present invention.
Figure 25:
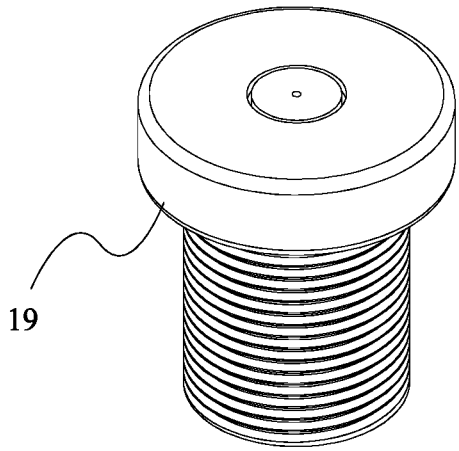
FIG. 25 is a perspective view of a vent cap of the present invention.
Figure 26:
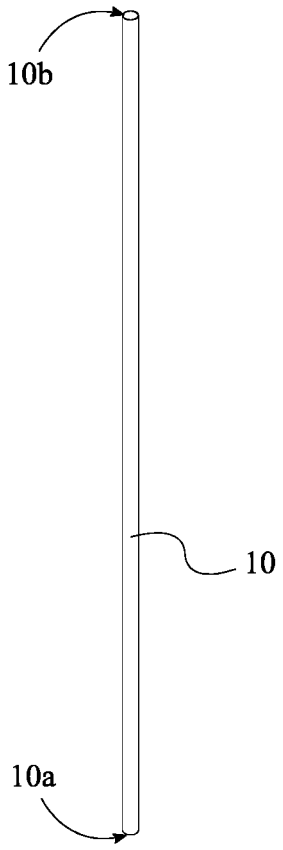
FIG. 26 is a perspective view of an internal tube of the present invention.

In reference to FIG. 21 through FIG. 24, the reservoir handle 1 comprises a handle neck 17, wherein the handle neck 17 is positioned adjacent the first end 5 of the reservoir handle. Preferably, the handle neck 17 is threaded and functions as an interfacing component with the head receptacle 2. Accordingly, the handle neck 17 is engaged with the handle port 13, by engaging with the threaded inner surface of the handle port 13. However, the reservoir handle 1 and the head receptacle 2 may be connected through any other method or fastening technique that are known to one of ordinary skill in the art, as long as the intents of the present invention are not hindered. As seen in FIG. 24, and FIG. 25, the reservoir handle 1 comprises a vent port 18 and a vent cap 19. Preferably, the vent port 18 traverses into a second end 20 of the reservoir handle 1, wherein the second end 20 of the reservoir handle 1 is positioned opposite to the first end 5 of the reservoir handle 1 across the reservoir handle 1. Preferably, the second end 20 constitutes a lower end of the reservoir handle 1. Thus, as seen in FIG. 1 through FIG. 6, the vent port 18 is located on the surface of the reservoir handle 1 with the larger circumference. Further, the vent port 18 is threaded to match the thread from the vent cap 19, so that the vent cap 19 is engaged within the vent port 18. In the preferred embodiment, the vent cap 19 is a one-way vent cap with a conventional umbrella valve, which allows for steady flow of paint. Furthermore, vent cap 19 is preferably of circular shape and designed to match the vent port 18, such that, when the vent cap 19 is engaged within the vent port 18, the vent cap 19 seals the vent port 18. Accordingly, when needed, the user may remove the vent cap 19 to reveal the vent port 18 and access the inside of the reservoir handle 1. It should be further noted that, the vent port 18 and the vent cap 19 may comprise any other shape, size, and fastening mechanism, as long as the objectives of the present invention are not altered.

To accomplish the smooth operation of the device, as well as to ensure that the fluid canal 9 is normally aligned, the removable brush head 3 must dock on to the head receptacle 2. This is so that the fluid canal 9 traversing through the head receptacle 2 is colinear with the fluid canal traversing through the head body 6, and thus the fluid delivery tube 10 may traverse through the fluid canal 9 and deliver paint without any issues. To that end, the present invention comprises a plurality of first fasteners 21, and a plurality of second fasteners 22. According to the preferred embodiment, the plurality of first fasteners 21 is laterally mounted onto the head receptacle 2, and the plurality of second fasteners 22 is laterally mounted onto the brush head 3. Preferably, the plurality of first fasteners 21 is a plurality of brush head retaining clips and the plurality of second fasteners 22 is a plurality of retaining stubs. The plurality of brush head retaining clips functions as a locking feature and as a receptacle, that is designed to fit and match the plurality of retaining stubs from the removable brush head 3. Thus, when the brush head 3 is docked into the head receptacle 2 and the plurality of retaining stubs is engaged with the plurality of retaining clips, the brush head is locked, docked and secured. In other words, the plurality of second fasteners 22 is detachably engaged with the plurality of first fasteners 21. However, the plurality of first fasteners 21 and the plurality of second fasteners 22 may include any other size, shape, and fastening mechanisms etc., that are known to one of ordinary skill in the art, as long as the objectives of the present invention are fulfilled.

Figure 21:
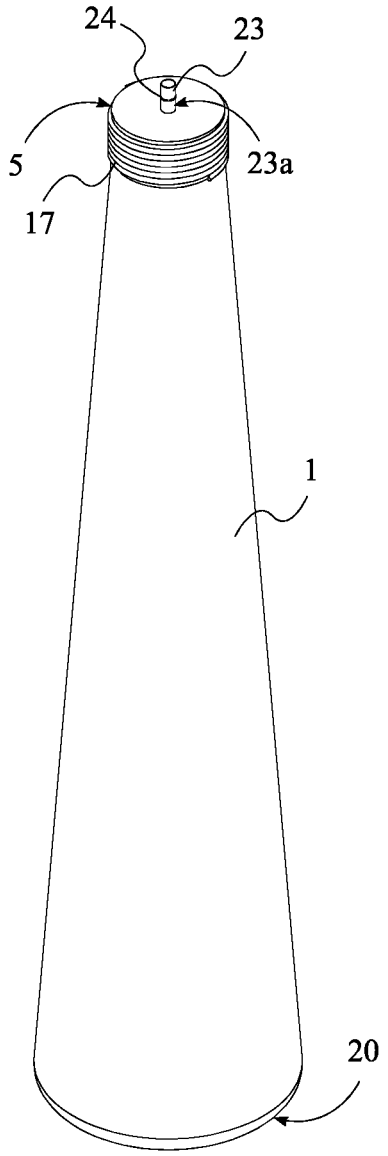
FIG. 21 is a perspective view of a reservoir handle of the present invention.
Figure 22:
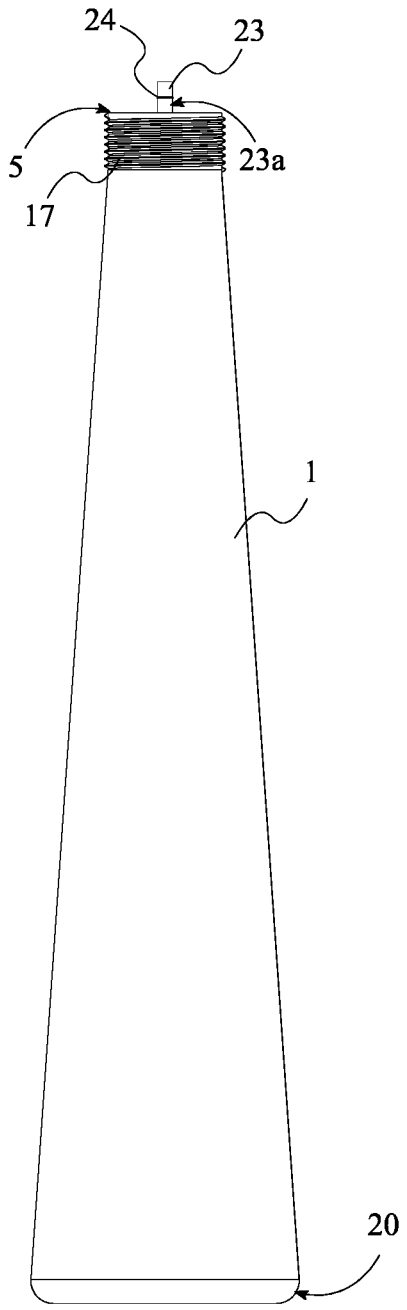
FIG. 22 is a front view of the reservoir handle of the present invention.int
Figure 23:
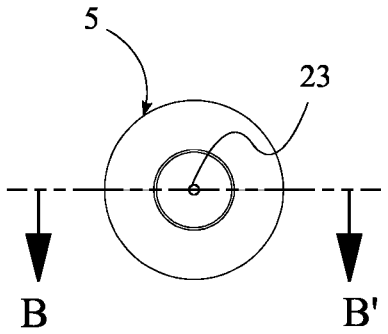
FIG. 23 is a top view of the reservoir handle of the present invention.

As seen in FIG. 6, FIG. 21 through FIG. 24, the present invention comprises an interconnecting tube 23, wherein the interconnecting tube 23 is terminally mounted onto the first end 5 of the reservoir handle. The interconnecting tube 23 serves as a connection and interface with the fluid delivery tube 10, such that the first end of the fluid delivery tube 10*a* is in fluid communication with the storage cavity 8 through the interconnecting tube 23. Preferably, the interconnecting tube 23 is to be manufactured of any soft and liquid repellent material. Further, the interconnecting tube 23 comprises a crimp 24, wherein the crimp 24 protrudes outward along a lateral sidewall 23*a* of the interconnecting tube 23. In the preferred embodiment, the first end of fluid delivery tube 10*a* is engaged with the crimp 24, such that the crimp 24 acts as a sealing interface between the interconnecting tube 23 and the fluid delivery tube 10. As seen in FIG. 21 and FIG. 22, the crimp 24 has a circular profile. Furthermore, as seen in FIG. 6, a transversal cross section of the fluid delivery tube 10 is larger than a transversal cross section of the interconnecting tube 23. In other words, in order for the fluid delivery tube 10 to properly interface with the interconnecting tube 23, the dimensions must be such that a diameter of the interconnecting tube 23 is slightly smaller than that of the fluid delivery tube 10. Thus, the present invention enables users to facilitate efficient painting process.

Although the invention has been explained in relation to its preferred embodiment, it is to be understood that many other possible modifications and variations can be made without departing from the spirit and scope of the invention as hereinafter claimed.

What is claimed is:

1. A paint brush device with controlled paint flow system, the device comprising:

a reservoir handle;

a head receptacle;

a brush head;

a fluid delivery system;

the fluid delivery system comprising at least one storage cavity, at least one fluid canal, at least one delivery tube, and a flow control device;

the head receptacle being detachably mounted in between a first end of the reservoir handle and the brush head;

the storage cavity being positioned within the reservoir handle;

the fluid canal traversing through the head receptacle and the brush head;

the fluid delivery tube being threaded through the fluid canal;

a first end of the fluid delivery tube being in fluid communication with the storage cavity;

a second end of the fluid delivery tube extending through the brush head;

the flow control device being operatively coupled to the fluid delivery tube, wherein manipulating the flow control device governs the flow of fluid out of the storage cavity and through the fluid delivery tube.

2. The paint brush device of claim 1, wherein the reservoir handle and the fluid delivery tube being compressible.

3. The paint brush device of claim 1, comprising:

the brush head comprising a head body and a plurality of bristles;

the plurality of bristles being mounted adjacent to the head body, opposite to the reservoir handle; and the fluid canal traversing normally and centrally through the head body.

4. The paint brush device of claim 1, the head receptacle comprising:

a recess;

a handle port;

a control canal;

the recess traversing into a first section of the head receptacle;

the handle port traversing into a second section of the head receptacle, opposite to the recess;

the fluid canal traversing normally and centrally through the second section;

the control canal laterally traversing through the second section; and the control canal extending into the fluid canal.

5. The paint brush device of claim 4, comprising:

the flow control device being threaded through the control canal; and the brush head being mounted within the recess.

6. The paint brush device of claim 4, comprising:

the flow control device comprising a screw head and a screw body;

the screw head being terminally connected to the screw body;

the screw head protruding outside the head receptacle adjacent the control canal; and the screw body being rotatably coupled with the control canal.

7. The paint brush device of claim 4, comprising:

the reservoir handle comprising a handle neck;

the handle neck being positioned adjacent the first end of the reservoir handle; and the handle neck being engaged with the handle port.

8. The paint brush device of claim 1, the reservoir handle comprising:

a vent port;

a vent cap;

the vent port traversing into a second end of the reservoir handle, wherein the second end of the reservoir handle is positioned opposite to the first end of the reservoir handle across the reservoir handle;

the vent cap being engaged within the vent port; and the vent cap sealing the vent port.

9. The paint brush device of claim 1, comprising:

a plurality of first fasteners;

a plurality of second fasteners;

the plurality of first fasteners being laterally mounted onto the head receptacle;

the plurality of second fasteners being laterally mounted onto the brush head;

the plurality of second fasteners being detachably engaged with the plurality of first fasteners.

10. The paint brush device of claim 1, comprising:

an interconnecting tube;

the interconnecting tube being terminally mounted onto the first end of the reservoir handle; and the first end of the fluid delivery tube being in fluid communication with the storage cavity through the interconnecting tube.

11. The paint brush device of claim 10, comprising;

a crimp;

the crimp protruding outward along a lateral sidewall of the interconnecting tube;

the first end of fluid delivery tube being engaged with the crimp; and the crimp being a sealing interface between the interconnecting tube and the fluid delivery tube.

12. The paint brush device of claim 10, wherein a transversal cross section of the fluid delivery tube being larger than a transversal cross section of the interconnecting tube.

13. A paint brush device with controlled paint flow system, the device comprising:

a reservoir handle;

a head receptacle;

a brush head;

a fluid delivery system;

the fluid delivery system comprising at least one storage cavity, at least one fluid canal, at least one delivery tube, and a flow control device;

the head receptacle being detachably mounted in between a first end of the reservoir handle and the brush head;

the brush head comprising a head body and a plurality of bristles;

the plurality of bristles being mounted adjacent to the head body, opposite to the reservoir handle;

the fluid canal traversing normally and centrally through the head receptacle and the head body;

the storage cavity being positioned within the reservoir handle;

the fluid delivery tube being threaded through the fluid canal;

a first end of the fluid delivery tube being in fluid communication with the storage cavity;

a second end of the fluid delivery tube extending through the brush head;

the flow control device being operatively coupled to the fluid delivery tube, wherein manipulating the flow control device governs the flow of fluid out of the storage cavity and through the fluid delivery tube.

14. The paint brush device of claim 13, wherein the reservoir handle and the fluid delivery tube being compressible.

15. The paint brush device of claim 13, the head receptacle comprising:

a recess;

a handle port;

a control canal;

the recess traversing into a first section of the head receptacle;

the handle port traversing into a second section of the head receptacle, opposite to the recess;

the fluid canal traversing normally and centrally through the second section;

the control canal laterally traversing through the second section;

the control canal extending into the fluid canal;

the flow control device being threaded through the control canal; and the brush head being mounted within the recess.

16. The paint brush device of claim 15, comprising:

the flow control device comprising a screw head and a screw body;

the screw head being terminally connected to the screw body;

the screw head protruding outside the head receptacle adjacent the control canal; and the screw body being rotatably coupled with the control canal.

17. The paint brush device of claim 15, comprising:

the reservoir handle comprising a handle neck;

the handle neck being positioned adjacent the first end of the reservoir handle; and the handle neck being engaged with the handle port.

18. The paint brush device of claim 13, the reservoir handle comprising:

a vent port;

a vent cap;

the vent port traversing into a second end of the reservoir handle, wherein the second end of the reservoir handle is positioned opposite to the first end of the reservoir handle across the reservoir handle;

the vent cap being engaged within the vent port; and
the vent cap sealing the vent port.

19. The paint brush device of claim 13, comprising:

a plurality of first fasteners;

a plurality of second fasteners;

the plurality of first fasteners being laterally mounted onto the head receptacle;

the plurality of second fasteners being laterally mounted onto the brush head;

the plurality of second fasteners being detachably engaged with the plurality of first fasteners.

* * * * *